US005511969A

United States Patent [19]

Lopes et al.

[11] Patent Number: 5,511,969

[45] Date of Patent: Apr. 30, 1996

[54] HYDRO-OILY EMULSION BURNING PROCESS

[75] Inventors: Homero V. d. M. Lopes; Douglas F. Monteiro, both of São Paulo, Brazil

[73] Assignees: Homero Lopes & Associados; Engenharia E Comerico Ltda., both of São Paulo, Brazil

[21] Appl. No.: 318,796

[22] PCT Filed: Apr. 15, 1993

[86] PCT No.: PCT/BR93/00013

§ 371 Date: Dec. 13, 1994

§ 102(e) Date: Dec. 13, 1994

[87] PCT Pub. No.: WO93/21480

PCT Pub. Date: Oct. 28, 1993

[30] Foreign Application Priority Data

Apr. 16, 1992 [BR] Brazil ..... PI 9201543

[51] Int. Cl.[6] ..... F23D 11/16

[52] U.S. Cl. ..... 431/4; 431/8; 431/11

[58] Field of Search ..... 431/4, 2, 11, 8

[56] References Cited

U.S. PATENT DOCUMENTS

| | | | |
|---|---|---|---|
| 3,876,363 | 4/1975 | Lahaye . | |
| 4,144,015 | 3/1979 | Berthiaume | 431/4 X |
| 4,430,054 | 2/1984 | Furuya . | |
| 4,688,550 | 8/1987 | Lopes . | |
| 5,249,957 | 10/1993 | Hirata | 431/4 X |

FOREIGN PATENT DOCUMENTS

| | | |
|---|---|---|
| 61-215696 | 9/1986 | Japan . |
| 62-291457 | 12/1987 | Japan . |
| 410773 | 5/1934 | United Kingdom . |
| WOA8002589 | 11/1980 | WIPO . |

*Primary Examiner*—Carl D. Price

*Attorney, Agent, or Firm*—Darby & Darby

[57] ABSTRACT

A burning process comprising the steps of emulsifying fuel oil with water and aerating the emulsion in a mixing tank until there is a substantial reduction of its density. The emulsion is then stabilized in a resting tank under adequate temperature and pressure conditions for maintaining an deaerating the emulsion. The stabilized emulsion is conducted to a burner nozzle where it is pulverized into particles by means of abrupt decompression in an environment poor of air.

12 Claims, 2 Drawing Sheets

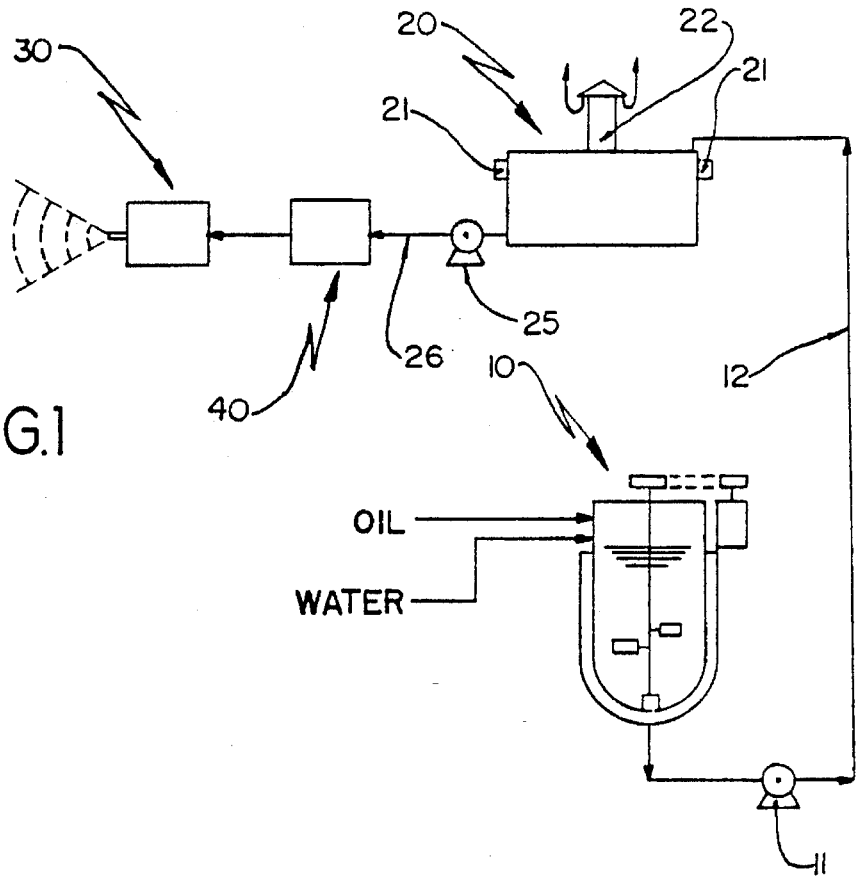
FIG.1
FIG. 3
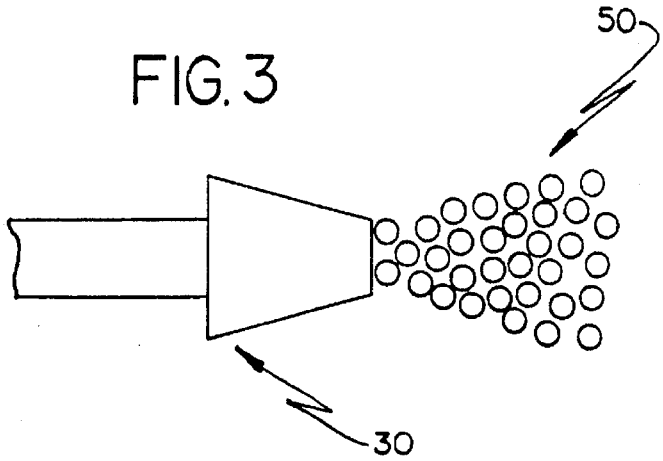
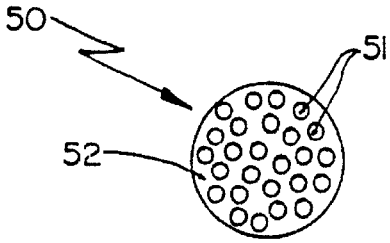
FIG.4

HYDRO-OILY EMULSION BURNING PROCESS

TECHNICAL FIELD

The present invention is applicable to a process for burning an emulsion of water and a fuel oil, with a high heat-generating yield, including the procedures to obtain and stabilize this emulsion, under adequate conditions for the proposed burning process.

BACKGROUND ART

The optimization of burning together with the inherent economy of fuel obtained, has been, over the years, a permanent concern of those responsible for manufacturing and/or operating heat-generating units, as well as of the suppliers of fuels, that is, the distributors of oil products. By this token, numerous papers have been developed by the involved parties, as well as in the field of emulsifying fuel oil with water. However, whether due to the operational sequence, or whether due to the process conditions adopted, in spite of the high degree of technological development reached in heat-generating equipment, relatively little progress has been reached in the last two decades in terms of fuel economy, whereas the most relevant results obtained do no more pertain changes in the fuel itself, but are due to a more accurate control of burning, obtained through the aid of computer technology. Concerning the techniques of emulsifying fuel oil and water, instant emulsification, emulsion additivation, as well an endless number of mechanical and/or chemical modification processes were developed aiming at, among other parameters, the possibility of adding, under stable conditions, larger amounts of water to emulsions, in order to obtain yields of heat at least equal to fuel oil in terms of mixture with air.

However, the most efficient known processes for hydro-emulsifying fuel oil have provided gains in heat yields at an average of about 3%, or at a maximum between around 5 and 8%, if compared with the yield by burning a perfectly adjusted air/oil mixture.

Even for those who are not familiar with the art, it must seem intuitively evident that, if adequately used, the ideal adjuvant of fuel oil in terms of costs is water.

By this token, and taking as a basis the knowledge of the art then available, the applicant, for the first time, decided to develop persevering studies with the purpose of optimizing process conditions related to each operational stage of hydro-emulsification. The records presented, for the first time, references to improved stability characteristics and heat value of hydro-oily emulsions for burning in burner nozzles of heat-generating equipment, by simply adjusting time, pressure and temperature parameters.

Although describing a hydro-oily solution burning process, including the steps of emulsifying, deaerating, conducting and pulverizing the emulsion, the most recent state of the art does not get to determine, in a clear manner, the basic conditions for the different steps in order to reach the intended results and the reactions of imperative occurrence during the pulverization steps, for it to be possible to reach an economy in different experiments.

Thus, the present invention has the basic object to provide a hydro-oily emulsion burning process at the burner nozzle of a heat-generating equipment, with a high heat yield and low implementation cost.

It is also an object of the present invention to provide a hydro-oily emulsion burning process, as described above, including a procedure for obtention and stabilization of the referred hydro-oily emulsion.

It is a further object of the current invention to provide a hydro-oily emulsion burning process, as described above, in which the referred emulsion encloses a water concentration markedly superior to the usual water concentrations obtained, associated to an equally superior heat value.

DISCLOSURE OF THE INVENTION

These and other objectives and advantages of the current invention are reached through the provision of a hydro-oily emulsion burning process, of the type composed of water and fuel oil, to be burnt at the burner nozzle of a heat-generating equipment, including the steps of: emulsifying and aerating water and fuel oil, by means of agitation in a mixing tank, the water being maintained at a minimum temperature of 20° C.±2° C. and the fuel oil at a maximum temperature lower than that of vaporization of water and at an adequate working pressure to facilitate the desired emulsification, the concentration of water in the emulsion being calculated to react stoichiometrically during combustion, producing hydrogen and carbon dioxide, said emulsion being maintained at a temperature sufficient to permit an interfacial tension between fuel oil and water and air, at compatible levels to stabilize the emulsion and at a pressure corresponding to a temperature of saturated water steam substantially higher than the temperature of the emulsion, so that the latter presents all the water maintained in the form of droplets of around 1 to 10 microns, uniformly dispersed, together with micro bubbles of air, in the fuel oil, the speed and time of agitation being determined in order that the aerated emulsion obtained presents specific gravity around 20±5% lower than the deaerated hydro-oily emulsion; stabilizing the aerated emulsion in a rest tank, maintained under temperature and pressure conditions that ensure the required ratio of interfacial tension between water and oil and maintenance of the water concentration , for a period of time required and sufficient to practically fully deaerate said emulsion; conducting the deaerated and stabilized emulsion to a burner nozzle, maintaining the emulsion conduction temperature between a maximum value, corresponding to that of a saturated steam pressure mandatorily lower than the emulsion conduction pressure, and a minimum value corresponding to the minimum sensible heat stored, capable of vaporizing a minimum quantity of water under an abrupt pressure drop condition, by pulverization at the burner nozzle, the pressure of conduction of the emulsion being maintained within the operating values required by the burner; pulverizing the emulsion through the burner, in uniform particles of around 20 to 150 microns, each particle comprising plurality of said water droplets in the emulsion, surrounded by a film of oil, said pulverization being effected so as to provoke an abrupt depressurization of the emulsion, sufficient to cause the instantaneous vaporization (flashing) of part of the water from the droplets and the consequent disintegration of the particles of the pulverized emulsion, said pulverization being effected in an environment sufficiently poor of air in order to avoid direct formation of carbon dioxide and to convey the following reactions:

a partial combustion of the fuel oil with part of the oxygen available in the pulverization environment, forming carbon monoxide and releasing heat;

b reduction of water vaporized during the abrupt depressurization of the emulsion, by means of a stoichiometric amount of part of the referred carbon monoxide, forming carbon dioxide and hydrogen and releasing heat, c oxidation of hydrogen, from reaction b, with the remaining oxygen available in the pulverization environment, forming hiperheated water steam at burner flame temperature, d vaporization of water, remaining in the droplets, by the heat produced in reactions a and b;

e reduction of water vaporized in reaction d by the carbon monoxide remaining from step a, through chain reactions identical to reactions b and c, so as to provoke the total combustion (burning) of the oil.

The innovation presented by the proposed invention translates into a process of burning a hydro-oily emulsion of fuel oil and water, including the required procedures for obtaining and stabilizing the specified emulsion, which incorporates a high quantity of water in relation to those quantities conventionally used and which also presents an increased heat value. In practical terms, the proposed process presents, among others, the following advantages, providing the user consumption reductions to the order of 25%; emulsions with a high incorporation of water, which participates chemically of highly exothermal reactions and contributes, therefore, positively to the heat balance of all the stages of the process; based on the micro pulverization of fuel and the high temperature of this burning process practically the entire solid particulate material residues are eliminated, that is, the burning is practically complete and perfect, thus reducing to a minimum stoppages and expenses with maintenance such as nozzle cleaning, filters and others.

BRIEF DESCRIPTION OF THE DRAWINGS

Next, the invention is described with reference to the attached drawings, wherein:

FIG. 1 represents a schematic view of an installation for emulsifying, stabilizing and burning a hydro-oily emulsion, according to the proposed process;

FIG. 3 represents an enlarged view of the flashing region of FIG. 2, presenting the particulated emulsion, before suffering the flashing phenomenon; and FIG. 4 represents an enlarged view of an emulsion particle, according to FIG. 3.

BEST MODE FOR CARRYING OUT THE INVENTION

Figure 2:
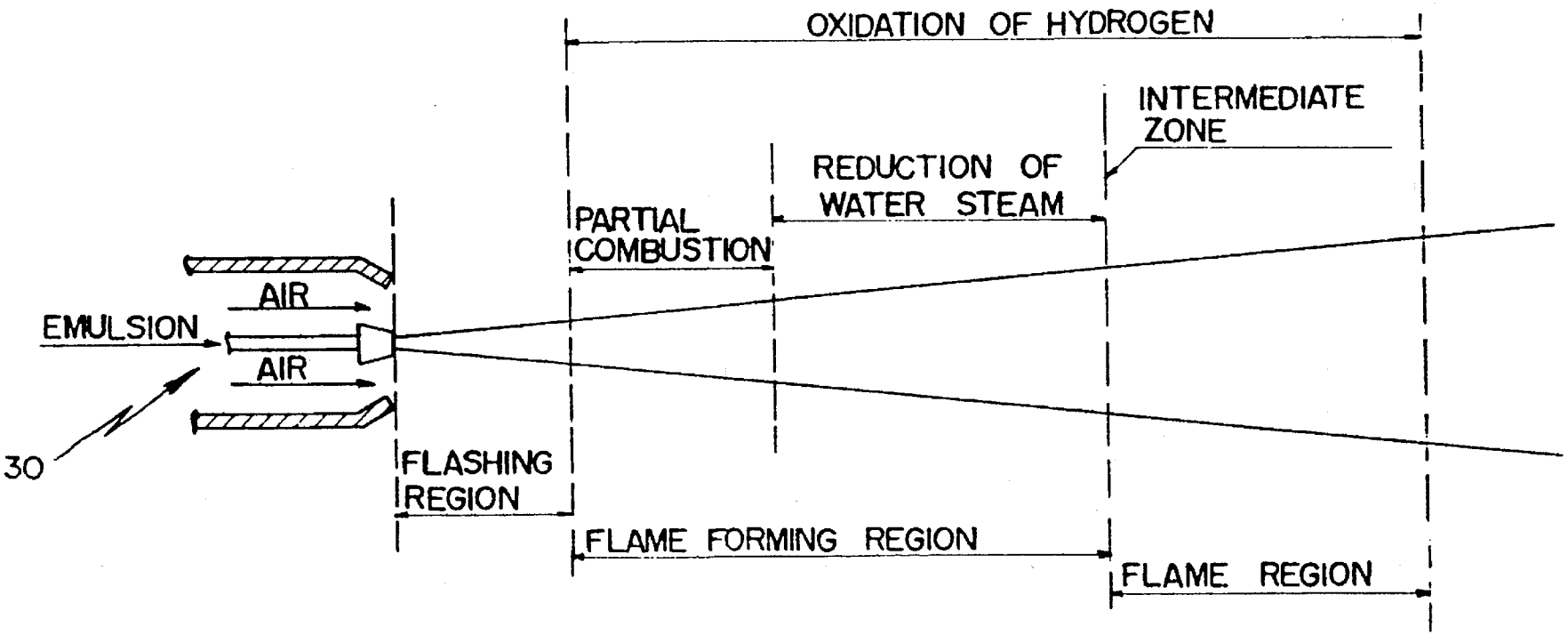
FIG. 2 represents a schematic view of the flame profile produced by the proposed process, presenting the described flame regions as well as the types of chemical reactions occurring in these regions.

According to the figures described, the hydro-oily emulsion burning process, of the type composed by fuel oil and water, to be burned at the burner nozzle of a heat-generating equipment, comprises the stages of: preparing the oil and water emulsifying and aerating oil and water, stabilizing and deaerating the emulsion formed, and pulverizing the stabilized emulsion, including its burning.

The step of forming the emulsion consists in agitating, preferably mechanically and at 700 rpm, during a predetermined period, normally varying around 2 and 3 minutes, in a heated and eventually pressurized mixing tank 10, a pre-heated fuel oil at a temperature varying, depending on the viscosity of the oil used, between about 50° and 200° C., with water at a maximum temperature lower than that of vaporization at working pressure and minimum of 20° C.±2° C. and preferably demineralized or softened, such water generally being admitted in the mixing tank 10 as a jet tangent to the wall of the latter and along the same course as the agitation of the oil, and in a predetermined amount depending on the viscosity of the oil utilized and the stoichiometric condition required for the combustion reaction, to be described ahead. The emulsion formed generally presents a composition containing between 55 and 70% fuel oil and between 45 and 30% water, and a temperature after beating between 70° and 90° C. in a non-pressurized tank and above 90° C. in a pressurized mixing tank.

The step described above is generally effected at atmospheric pressure for oils presenting viscosities lower than 100 cst (130° C.); above this viscosity, emulsification is processed under pressure, generally varying between 2 and 10 kgf/cm$^2$, in order to avoid losses of emulsion water through evaporation, because of the high temperature required to liquefy the fuel oil. In other words, we can say that the pressure in the mixing tank should correspond to a vaporization temperature of water, substantially higher than that of the emulsion.

Since, during the process of agitating a liquid, aeration occurs at a proportional rate to the speed and time of agitation, it is important to maintain the above mentioned speed, preferably around 700 rpm, during a period of time generally between 2 to 3 minutes, so as to control the volume of air absorbed, since this was determined experimentally as the ideal volume of air (or of inert gas, when the high temperature of fuel oil is favorable for its oxidation), around 20% of the total volume of water and oil, that is, such a volume that will reduce the specific gravity of the emulsion by around 20%±5%. Under the conditions described above, an emulsion is produced whereby the water droplets with diameters of around 1 to 10 microns are evenly dispersed in oil, and where said emulsion is permeated with micro bubbles of air, also evenly distributed.

The micro bubbles of air, as well as the water droplets, as distributed, are fully surrounded by fuel oil, once the interfacial tension of the latter with the first ones is smaller than the interfacial tension between the first. In this manner, the total interfacial surface of oil corresponds to the summing up of the external surfaces of the water droplets and of the micro bubbles of air, or yet, there is full contact between the fuel oil and the two last ones in the formed emulsion.

The formed emulsion is duly aerated and transferred, through pump 11 and respective tubing 12, to a rest tank 20, where it should remain for a period of around 6 to 12 hours, under suitable conditions to maintain stable such an emulsion, conditions which should also be based on its concentration, oil viscosity and temperature required to maintain the desired ratio of the interfacial tension within the latter.

Pressurization will be utilized in this stage when the oil viscosity goes over 225 cst (130° C.), since such an oil requires, in order to flow sufficiently, high temperatures so that under atmospheric pressure conditions, they are able to promote evaporation of water from the emulsion.

During the rest tank step, as described above, the deaeration of the emulsion occurs and, with the displacement of the micro bubbles of air, occupation of its space by the fuel oil occurs, contributing to a perfect and uniform involvement of the droplets by the latter. The deaeration operation of said emulsion is equally important in its stabilization step, due to the fact that air is a poor heat conveyor, therefore, the micro bubbles of air are acting as a thermal barrier. Their elimination, therefore, will permit a perfect distribution of heat throughout the whole emulsion.

In cases of non-pressurization of the rest tank 20, that is, when the fuel oil utilized presents viscosity up to 225 cst (130° C.), the deaeration can be processed through ventilation on the surface of the emulsion, obtained by means of circulation of air through air intake vents 21, the air taken in being re-expelled by a chimney 22, with its height dimensioned so as to allow drawing the air out through a thermo-siphon mechanism, thus avoiding formation of negative pressures on the surface of the emulsion, which would impair the stability of the same.

Following stabilization, the emulsion should go through a critical step of the process in question, which is, it being conducted from the rest tank 20 to the burner nozzle 30. This operation, generally effected through pump 25 and respective piping 26, should be effected in such a manner as to ensure maintaining the stability of said emulsion, thus avoiding the separation of water, be it in the form of steam, be it in the form of liquid. This condition is obtained by pumping the emulsion to a heater 40, where it will be heated up to such a temperature which will correspond to that of a water saturated steam pressure, preferably at around 15% lower than the pressure to which said emulsion is being subject during conduction. Higher temperatures would lead to separation of water by evaporation; lower temperatures would hinder transportation of the emulsion due to its increased viscosity.

The hydro-oily emulsion, duly stabilized, pressurized and heated, is then pumped to burner nozzle 30, to be pulverized into an environment sufficiently poor of air in order to avoid forming carbon dioxide directly, that is, to conduct only a partial combustion of the pulverized fuel oil. The emulsion is, pulverized in such a way as to form substantially spherical particles 50, presenting diameters of around 70 to 100 microns and, each one, defined by a mass of water droplets 51, finely dispersed, and surrounded by a film of oil 52.

The above described particles 50, when leaving burner nozzle 30 at a pre-determined temperature, generally between around 120° and 250° C., suffer an abrupt depressurization, producing instant vaporization, flashing of part of the water of the droplets (for example, around 5% to 20% of the mass of water) and, consequently, one micro explosion of each particle, disintegrating the oil films and provoking the formation of a fine mist by enhancement of the pulverizing effect. Next, the pulverized emulsion, as described above, goes on to the burning phase. To better understand the phenomenon, the flame area will be subdivided into three distinct regions: a flashing region, a flame formation region and the flame region itself (see FIG. 2).

At the flashing region, as described above, hiperpulverization of the fuel oil and vaporization of part of the water droplets of the emulsion occur. At the flame formation, basically, the reactions of the products generated from flashing, which are, the decomposition of fuel oil, completed by the radiation heat of the flame, the partial combustion of the decomposed oil mist, followed by the reduction of part of the vaporized water with a portion of CO, formed by the previous reaction occur.

The reaction of partial combustion of fuel oil from the flash, which is substantially exothermic, occurs at the ignition temperature of such an oil, with a portion of poor air admitted together with the emulsion at the burner nozzle, as follows:

$$C+\tfrac{1}{2}O_2 \rightarrow CO \quad \Delta H=-943 \text{ kcal/kg of CO}$$

Next, part of the water vaporized through flashing, corresponding, as already mentioned, to around 10% of the total water that composes the emulsion, suffers a reduction by a stoichiometric quantity of the carbon monoxide formed in the previous reaction, as follows:

$$CO+H_2O(v) \rightarrow CO_2+H_2 \quad \Delta H=-546 \text{ kcal/Kg of } H_2O(v)$$

A chain reaction of vaporization and reduction of the water remaining from the emulsion will occur at the flame formation region, whereas the oxidation of hydrogen formed from said chain reaction will occur as from its generation, until the flame region.

The oxidation of the hydrogen originated from the field oil decomposed during flashing, begins at the flame forming region. The oxidation of remaining carbon monoxide, not used for the reduction of steamed water, probably occurs immediately after the conclusion of the reduction reactions, at the intermediate zone.

Hydrogen formed from the reduction of steam coming from flashing is oxidized in the presence of the remaining, non reacted, portion of the quantity of poor air (oxygen) available in the pulverization environment, forming steam in the condition of gas, at flame temperature, through a strongly exothermic reaction.

$$H_2+\tfrac{1}{2}O_2 \rightarrow H_2O(v) \quad \Delta H=-3{,}211 \text{ kcal/kg of } H_2O(v)$$

Water, to be reduced by carbon monoxide, should be in the condition of steam. Thus, the liquid water remaining from the pulverized emulsion, that is, that which was not vaporized during flashing, corresponds to, for example, around 90% of the water of the emulsion, to be evaporated, presents the following thermal balance:

$$H_2O(l) \rightarrow H_2O(v) \quad \Delta H=+539 \text{ kcal/kg of } H_2O$$

Heat required for this vaporization is provided by the exotherms from partial combustion and reduction reactions occurring at the flame forming region. As the water is being vaporized, it becomes reduced by stoichiometric quantities of CO obtained from partial combustion of the fuel oil mist during flashing, with successive formation of hydrogen, which will next be oxidized by oxygen from atmospheric air, producing new quantities of steam in the condition of gas at flame temperature. These reduction and oxidation reactions occur in chains until all the water contained in the emulsion has reacted, and the final product of the chemical process is limited to steam gas and carbon dioxide. As from this point, all the process becomes physical.

The great amounts of heat obtained are transmitted to the heat reception system by radiation forced convection and conductions, heat exchange further occuring between steam-gas and carbon dioxide. Through the utilization of known measuring methods, it has been established that the flame temperature when burning an aqueous emulsion with a first oil, at a given flow rate considered only for the moiety of oil contained in the emulsion, is at least equal to the flame temperature in conventional burning of a higher flow of the referred first oil, considering the performance achievement of the two burning processes (emulsion and first oil) under the same conditions and by the same equipment. It has thus been verified, experimentally, that the burning of a certain amount of emulsion produces at least the same serviceable heat energy obtained through burning of a larger amount of an oil, identical to the one utilized in the emulsion.

The experimental establishment mentioned above allows us to conclude that a relative energetic gain exists, with burning the referred emulsion, the energetic gain being resultant from an increased availability of free $H_2$ for the combustion reaction (oxidation) which is strongly exothermic, free $H_2$ coming from the water portion of the emulsion, through the reduction reaction of flashing water and the remaining water (vaporized) by carbon monoxide resultant from the partial initial combustion of the emulsion's fuel oil.

The larger availability of free $H_2$ during the combustion process may be associated, in terms of relative heat energy gain, to the fact that a fuel oil presents a net heat value (NHV), which will be so much larger the more saturated is its molecule, that is, the larger the hydrogen/carbon ratio in its molecule is.

Thus, when burning the emulsion, the result obtained, in terms of energetic yield, is comparable to the one obtained through isolated burning of another hypothetical fuel oil, containing a higher hydrogen/carbon ratio in its molecule.

From what has been revealed, it is understood that the proposed process is so much more effective, the more unsaturated is the fuel oil utilized in the emulsion, a situation which occurs with fuel oils supplied by Brazilian refineries.

Further to the basic technical effect mentioned above and related to the obtention of a determined heat yield, through lower consumption of an unsaturated fuel oil it can further be established that the NHV yield of the aqueous emulsion with the mentioned first unsaturated fuel oil, is higher than the NHV of another fuel oil presenting the same carbonic chain as the first, however, saturated, according to technical literature.

It is understood that the fact commented above comes from the additional consumption of energy to dissociate the carbon-hydrogen bonds of the saturated molecules of another fuel oil. The saturated molecules of fuel oil present a higher NHV than the ones of unsaturated molecules. During a conventional process of burning saturated fuel oil, part of the energy produced is consumed to dissociate hydrogen-carbon links of the oil molecules.

In the case of conditions and reactions to which the emulsion is submitted, one is able to obtain energetic gain related to the availability of an amount of hydrogen in the burning process, corresponding to the one obtained with a corresponding saturated fuel oil, without the need to expend energy for dissociation of the carbon-hydrogen links of the saturated oil molecule, additional to those existing in the said first unsaturated oil used in the emulsion of the process in question.

To those skilled in the art, reading this process should reveal the application of the same to burning other unsaturated oils, including renewable ones, such as by-products from bio-digestors or from the alcohol-sugar industry and others, not constituting, however, impairment to the inventiveness demonstrated by the process, as exposed.

Finally, as may be observed, the proposed hydro-oily emulsion burning process further to its high heat yield, presents an extremely clean burn in terms of particulate matter, since the conversion of fuel oil into carbon dioxide and steam-gas is practically total, thus it should be considered as an important contribution of technology to the preservation of environment.

The process, due to containing water, will further permit its association to other technologies to control polution generated by $No_x$, $SO_2$ and $SO_3$, or the like.

The following non-limiting example illustrates the improved performance of the proposed process, in comparison to a conventional fuel-oil burning process:

TABLE

| | HIDROL | FUEL OIL | REMARKS |
|---|---|---|---|
| Steam production Kg/hour | 4713 | 4698 | — |
| Oil Consumption Kg/hour | 237,8 | 330,3 | Fuel-Oil savings 28% |
| Net Heat Produced Mcal/hour | 2,62 | 2,68 | Titre considered for each case |
| Particulate Emission Kg/hour | 0,537 | 2,5 | −78,5% |
| Specific Emission $SO_x$.Kg$SO_x$/Mcal (net) | 0,438 | 0,575 | Reduction 23,8% |
| Particulate specific Emission Grams/Mcal (net) | 205,0 | 932,0 | 78% |

Specification and Equipment
Tubular fire boiler (supplier: Pontin)
Nominal Steam Production: 5.000 Kg/hr.
Gauge Working Pressure: p = 10 Bar
Fuel: Fuel Oil (Net Heat Value = 9.650 Kcal/Kg: Viscosity = 70 cst @ 100° C.)
Burner: mechanical pressure (supplier: Coen)
Remarks:
1) Fuel Oil and Hidrol burning tests were effected under same conditions.
2) the values shown represent an average of measurements effected during 36 consecutive hours, for both burning tests.
3) Characteristics of the emulsion:
3.1-weight percent of oil: 64%
3.2-pressure of the emulsion at the burner for pulverization: 10 Bar
3.3-temperature of the emulsion at the burner for pulverization: 120° C.
4) Characteristics of the fuel-oil:
4.1-pulverization pressure: 10 Bar
4.2-pulverization temperature: 130° C.
5) Particulates collected according to EPA procedures.

We claim:

1. Hydro-oily emulsion burning process characterized in that it comprises the steps of:

emulsifying and aerating the water and the fuel oil, by means of agitation in a mixing tank, the water being maintained at a minimum temperature of 20° C.±2° C. and the fuel oil at a maximum temperature lower than that of vaporization of water and at an adequate working pressure to facilitate the desired emulsification, the concentration of water in the emulsion being calculated to react stoichiometrically during combustion, producing hydrogen and carbon dioxide, said emulsion being maintained at a temperature sufficient to permit an interfacial tension between fuel oil and water and air at compatible levels to stabilize the emulsion and at a pressure corresponding to a temperature of saturated water steam substantially higher than the temperature of the emulsion, so that the saturated water steam presents all the water maintained in the form of droplets of around 1 to 10 microns uniformly dispersed, together with micro bubbles of air, in the fuel oil, the speed and time of agitation being determined in order that the aerated emulsion obtained presents a specific gravity around 20%±5% lower than the deaerated hydro-oily emulsion;

stabilizing the aerated emulsion in a rest tank, maintained under temperature and pressure condition that ensure the required ratio of interfacial tension between water and oil and maintenance of the water concentration, for a period of time required and sufficient to practically fully deaerate said emulsion:

conducting the deaerated and stabilized emulsion to a burner nozzle, maintaining the emulsion conduction temperature between a maximum value corresponding to that a saturated steam pressure mandatorily lower than the emulsion conduction pressure and a minimum value corresponding to the minimum sensible heat stored capable of vaporizing a minimum quantity of water under an abrupt pressure drop condition, the pressure of conduction of the emulsion being maintained within the operating values required by the burner;

pulverizing the emulsion through the burner, in uniform particles of around 20 to 150 microns, each particle comprising a plurality of said water droplets in the emulsion, surrounded by a film of oil, said pulverization being effected so as to provoke an abrupt depressurization of the emulsion, sufficient to cause the instantaneous vaporization of part of the water from the droplets and the consequent disintegration of the particles of the pulverized emulsion, said pulverization being effected in an environment sufficiently poor of air in order to avoid direct formation of carbon dioxide and to convey the following reactions:

a. partial combustion of the fuel oil with part of an amount of oxygen introduced in the pulverization environment, forming carbon monoxide and releasing heat;

b. reduction of water vaporized during the abrupt depressurization of the emulsion, by means of a stoichiometric amount of part of the referred carbon monoxide, forming carbon dioxide and hydrogen and releasing heat;

c. oxidation of hydrogen, from reaction b, with the remaining oxygen available in the pulverization environment, forming hiperheated water steam at burner flame temperature;

d. vaporization of water, remaining in the droplets, by the heat produced in reactions a and b;

e. reduction of water vaporized in reaction d by the carbon monoxide remaining from step a, through chain reactions identical to reactions b and c, in order to provoke total combustion of the oil.

2. Process, according to claim 1, characterized in that the fuel oil is pre-heated to a temperature of around 50° C. to 200° C.

3. Process, according to claim 1, characterized in that the emulsification is performed through mechanical agitation at around 700 r.p.m., during periods of around 2 to 3 minutes.

4. Process, according to claim 1, characterized in that the emulsion temperature, after beating, is maintained between around 70° to 90° C. in a non pressurized mixing tank, or above 90° C. in a pressurized tank.

5. Process, according to claim 1, characterized in that the hydro-oily emulsion presents around 55% to 70% fuel oil.

6. Process, according to claim 1, characterized in that the stabilization and deaeration stage of the emulsion is performed at a temperature of around 70° C. to 90° C.

7. Process, according to claim 1, characterized in that the stabilization and deaeration stage is performed during a period of time varying between around 6 and 12 hours.

8. Process, according to claim 1, characterized in that the conduction temperature is, at most, corresponding to a pressure of water saturated steam around 15% lower than the emulsion conduction pressure.

9. Process, according to claim 8, characterized in that the conduction temperature of the emulsion to the burner nozzle ranges between around 120° C. and 250° C.

10. Process, according to claim 1, characterized in that around 10% of the water from the pulverized droplets are instantly vaporized by flashing.

11. Process, according to claim 1, characterized in that the partial combustion of fuel oil and reduction of gasified water by flashing occur at the ignition temperature of fuel oil.

12. Process, according to claim 1, characterized in that the water steam formed in the reaction of hydrogen oxidation, resulting from the reaction of reduction of water steam by flashing, presents itself at the burner flame temperature.

* * * * *